United States Patent [19]

Materniak, nee Balcerowicz et al.

[11] 4,152,844

[45] May 8, 1979

[54] EXHAUST SYSTEM FOR LAUNDRY DRYER

[76] Inventors: Gizela Materniak, nee Balcerowicz; Zdzislaw Materniak, both of 7211 Fielding Ave., Apt. 102, Montreal, Canada

[21] Appl. No.: 882,311

[22] Filed: Mar. 1, 1978

Related U.S. Application Data

[63] Continuation-in-part of Ser. No. 692,686, Jun. 4, 1976, Pat. No. 4,081,915.

[51] Int. Cl.[2] ..... F24F 13/18

[52] U.S. Cl. ..... 34/235; 98/41 AV; 98/41 SV; 98/99 R; 251/116

[58] Field of Search ..... 34/235; 98/99 R, 99.1, 98/89, 119, 41 AV, 41 SV; 285/9 M, 402; 251/116, 394; 137/625.38

[56] References Cited

U.S. PATENT DOCUMENTS

| | | | |
|---|---|---|---|
| 852,650 | 5/1907 | Cannon | 98/99 R |
| 1,031,456 | 7/1912 | Leslie | 98/99 R |
| 1,120,361 | 12/1914 | Bauer | 98/99 R |
| 2,047,714 | 7/1936 | Smith, Sr. | 285/402 |
| 3,073,525 | 1/1963 | Cislo | 98/41 SV |
| 3,280,896 | 10/1966 | Goodson et al. | 285/9 M |
| 3,285,155 | 11/1966 | Maltenfort | 98/119 |
| 3,510,099 | 5/1970 | Crump | 251/116 |
| 3,842,722 | 10/1974 | Miller | 98/119 |
| 3,990,475 | 11/1976 | Myers | 137/625.38 |
| 4,036,248 | 7/1977 | Yoshimori et al. | 137/625.38 |

FOREIGN PATENT DOCUMENTS

| | | | |
|---|---|---|---|
| 231123 | 5/1963 | Austria | 98/41 SV |
| 1466542 | 1/1967 | France | 285/9 M |

*Primary Examiner*—Henry C. Yuen

[57] ABSTRACT

A portable and removable window exhaust system for home appliances requiring outdoor venting (such as portable laundry dryer) which obviates the necessity of permanent installation and piercing an exterior wall of a building to vent the appliance to the outdoors. The main part of the system, the exhauster, is incorporated in a replacement window panel consisting of two transparent perimetrally reinforced sheets of clear transparent plastic, and forms an integral part of one of said window panels. The said exhauster is movable within the window replacement panel and, when in closed position, will not protrude from the outside of the window replacement part, giving appearance of regular closed window. Moreover, in the open position, the exhauster resembles a protective hood equipped with inter-connected spaced ribs forming a grill at the bottom edges of said exhauster, which perform as an exhaust outlet. Nevertheless, even when the exhauster is manually pushed into an open position, the replacement window insert remains tightly closed and the only functional opening at the rear of the exhauster is the one in a neck-like shape to which the flexible hose is connected. In consequence, the conventional flapper, of shutter, is eliminated and, since the said grill offers only a negligible resistance to the passage of the exhausted air, the load on the dryer electric motor is smaller, resulting in saving of electrical energy while in use.

8 Claims, 19 Drawing Figures

11
9
14
10
11

12
9
12

13
10
13

11
29
17
16
5
5
9
15
18
14
1
4
4
10
11

EXHAUST SYSTEM FOR LAUNDRY DRYER

This present application is a continuation-in-part of co-pending application Ser. No. 692,686, filed June 4, 1976, now U.S. Pat. No. 4,081,915 dated Apr. 4, 1978.

The present invention relates to an exhaust system for a laundry dryer. Conventional exhaust systems of the type described require piercing an outside wall and providing an outside vent connected to the dryer by means of a flexible hose. However, in a plurality of buildings, especially where the premises are rented, it is forbidden to make alterations to the walls of the building and/or to modify the window frames, and yet there is no provision for discharging the flow of the hot and humid air from a dryer to the outside. Therefore, the occupants cannot avail themselves of the advantages of a laundry dryer.

The object of the invention is to provide an exhaust system of the type described, which is designed to obviate the above-noted disadvantage in that it makes use of any window opening to serve as an outlet for the dryer exhaust air, while at the same time preventing cold air from entering the premises, especially during wintertime.

Another object of the invention resides in the provision of a system of the character described in which a window insert plate assembly fits within a window opening and makes sealing contact therewith, said assembly being provided with an exhaust outlet and with means to connect a flexible hose to said outlet. The exhaust outlet is provided with closure means to prevent entry of outside air when the dryer is not in use.

In accordance with another object of the invention, the closure means are manually operated between an open positioning extending externally from the plate insert and a closed position flush with the same, so as not to constitute any unsightly projection at the exterior of the window.

In accordance with another object of the invention, an insert is also provided to fit the interior window of a double window unit.

PURPOSE OF THE INVENTION

The object of the invention is to provide a removable, portable window exhaust system which:

1. is light, durable, simple, cheap and "install it yourself";
2. does not require a permanent installation;
3. does not require piercing the outside wall of a building;
4. eliminates the prohibitive cost of permanent installation required for installation of conventional exhaust hoods;
5. eliminates problems for tenants who are not allowed to make alterations to the walls of the building and/or to modify the window frames;
6. eliminates health hazard for those who disregard manufacturers' warning and are using dryers, simply witout venting at all;
7. eliminates a chance for mischief that could be done by an outsider through the wall opening;
8. eliminates potential tragedy when users of dryers simply open a window; children are attracted to open windows and, when not watched, can fall out;
9. eliminates the necessity of spending substantial amount of money (especially in low income bracket people) for other people's property;

10. enables the owner of such portable system to take it with him in case of moving to another place;
11. eliminates problems for landlords in cases when tenants are using dryers without venting them to the outdoors;
12. eliminates problems for landlords where conventional permanently installed hoods give the appearance of an outdated type of housing, unattractively looking and not cared for. It could mean lower valuation for the building.
13. Fills a long-felt need in a convenient effective manner and at a cost within the budget of the ultimate user.

The foregoing and other objects of the present invention will become more apparent during the following disclosure and by referring to the drawings, in which.

Figures 2, 3, 4, 5:
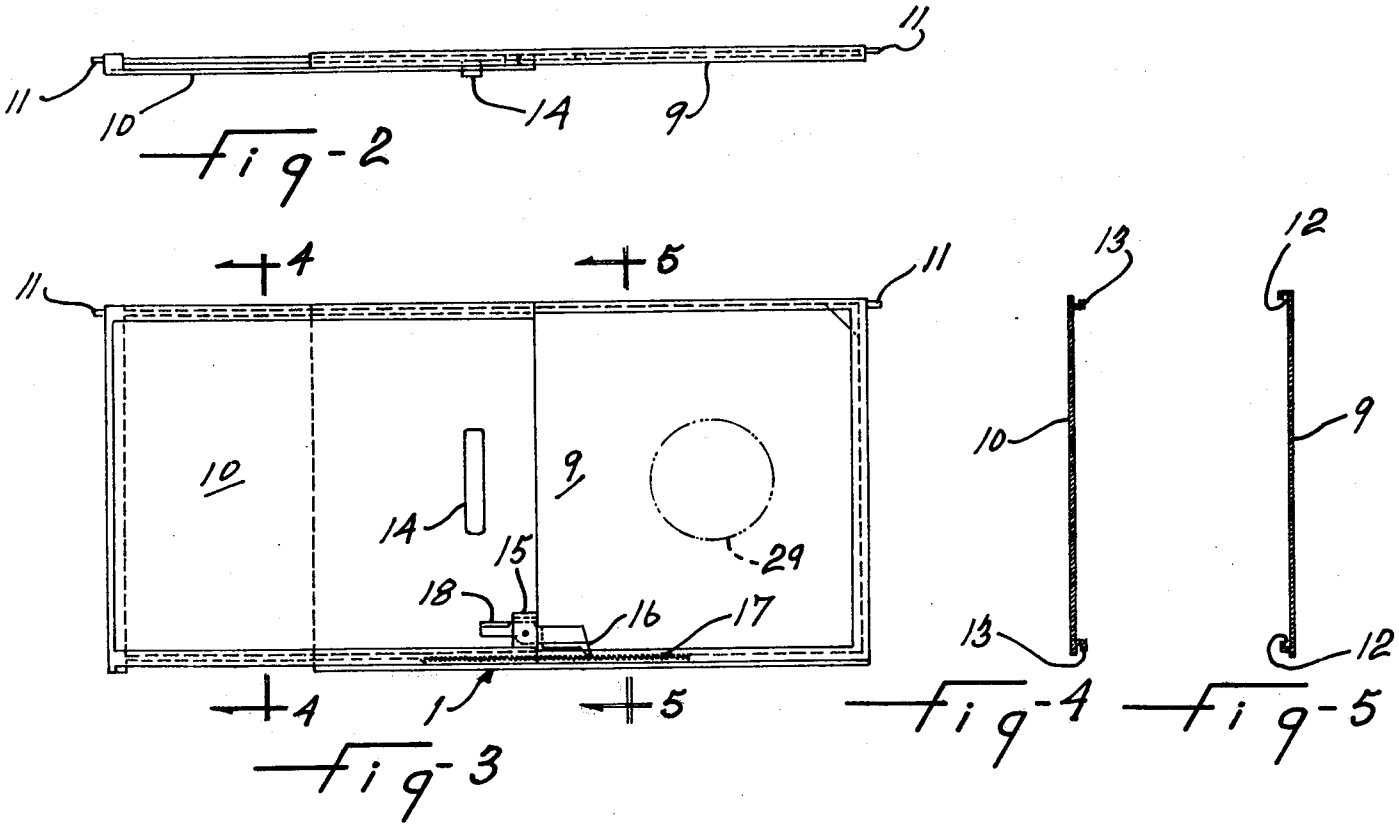
FIG. 2 is a top plan view of the exterior insert plate assembly.
FIG. 3 is an elevation of the assembly of FIG. 2.
Figure 6:
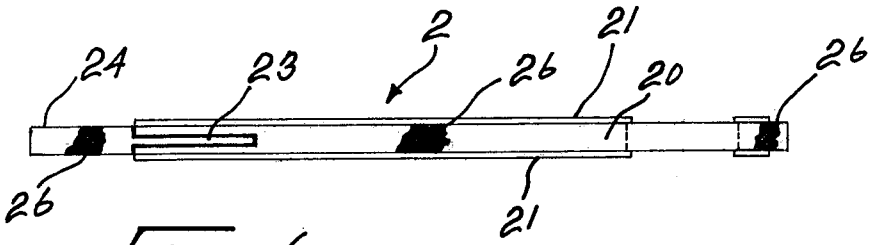
Figure 7:
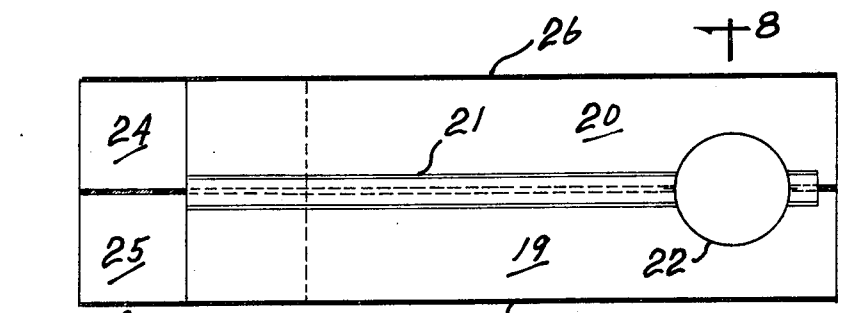
Figure 8:
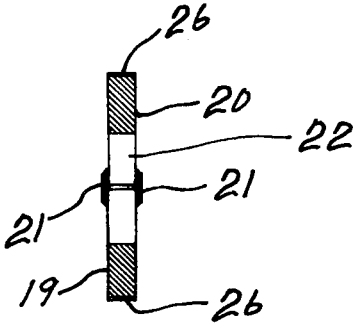
Figures 9, 10, 11, 12, 13, 14:
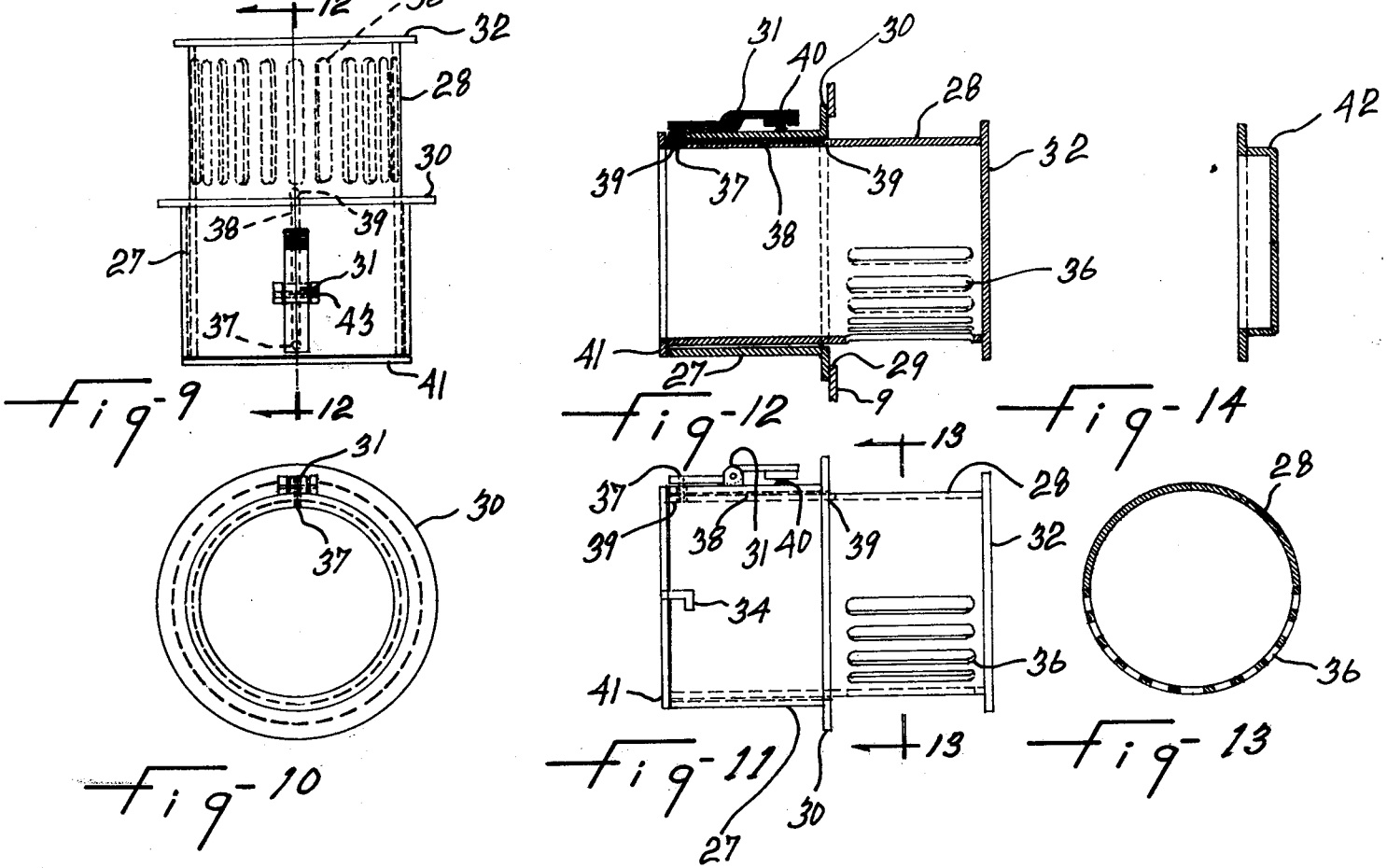

FIGS. 4 and 5 are cross-sections of the two sections of the assembly of FIG. 3 and taken along line 4—4 and 5—5, respectively;

FIG. 6 is a top plan view of the interior window insert plate assembly used for the interior window of a double window unit;

FIG. 7 is an elevation of the assembly of FIG. 6;

FIG. 8 is a cross-section taken along line 8—8 of FIG. 7;

FIG. 9 is a top plan view of the exhaust outlet incorporating manually-operated closure means;

FIG. 10 is an end elevation of the exhaust outlet of FIG. 9;

FIG. 11 is a side elevation of the outlet of FIG. 9;

FIG. 12 is a longitudinal section of the outlet of FIG. 9 and taken along line 12—12 of FIG. 9;

FIG. 13 is a cross-section taken along line 13—13 of FIG. 11;

FIG. 14, shown on the sheet containing FIGS. 9 to 13, is a section of a cap for closing the interior end of the outlet of FIG. 9.

Figures 15, 16, 17, 18, 19:
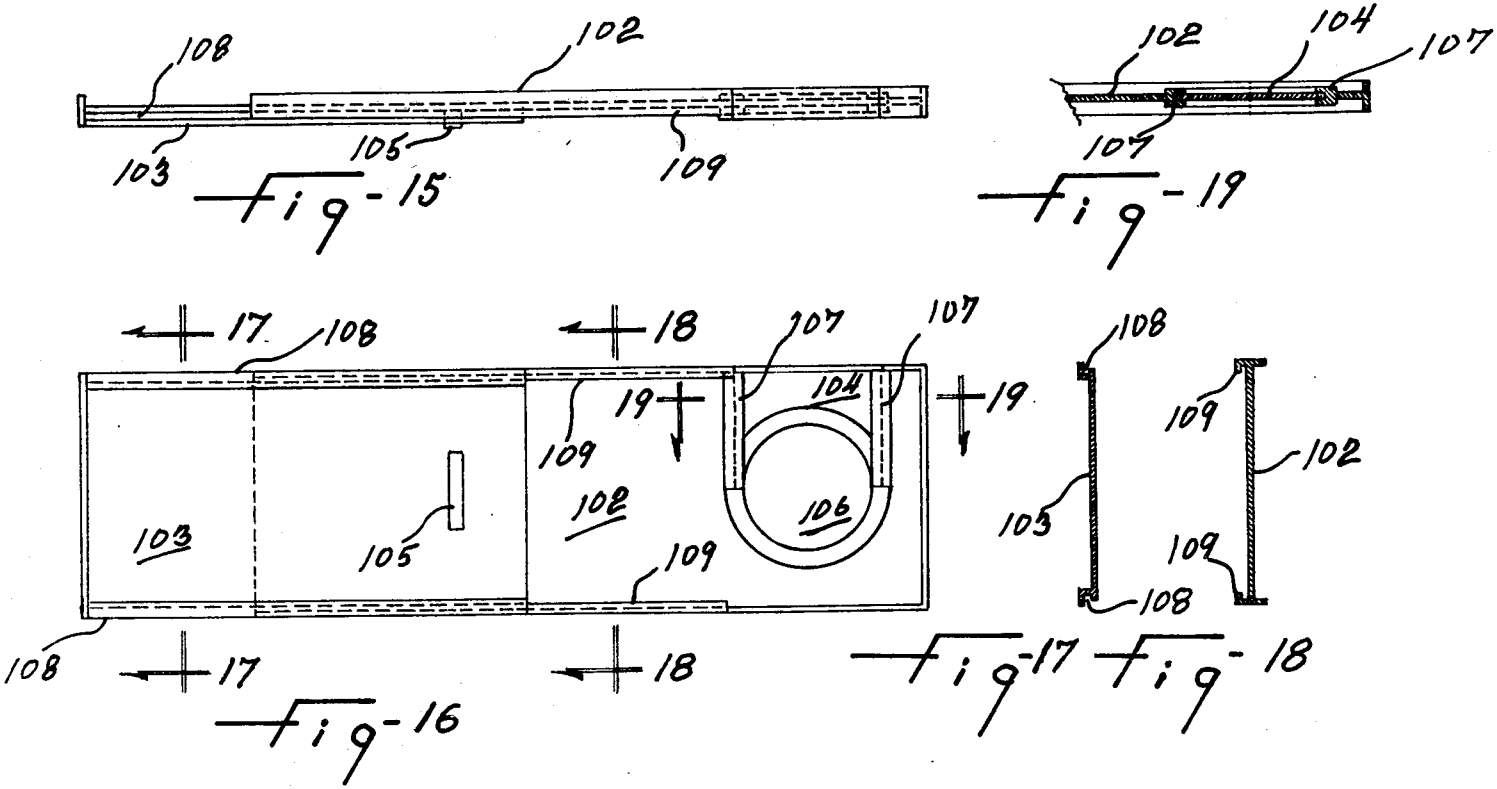

FIG. 15 is atop view of still another embodiment of the telescopic inner window insert plate assembly;

FIG. 16 is an elevation of the embodiment of FIG. 15; FIGS. 17 and 18 are cross-sections taken along lines 17—17 and 18—18, respectively, of FIG. 16; and FIG. 19 is a partial plan section taken along line 19—19 of FIG. 16.

In the drawings, like reference characters indicate like elements throughout.

Figure 1:
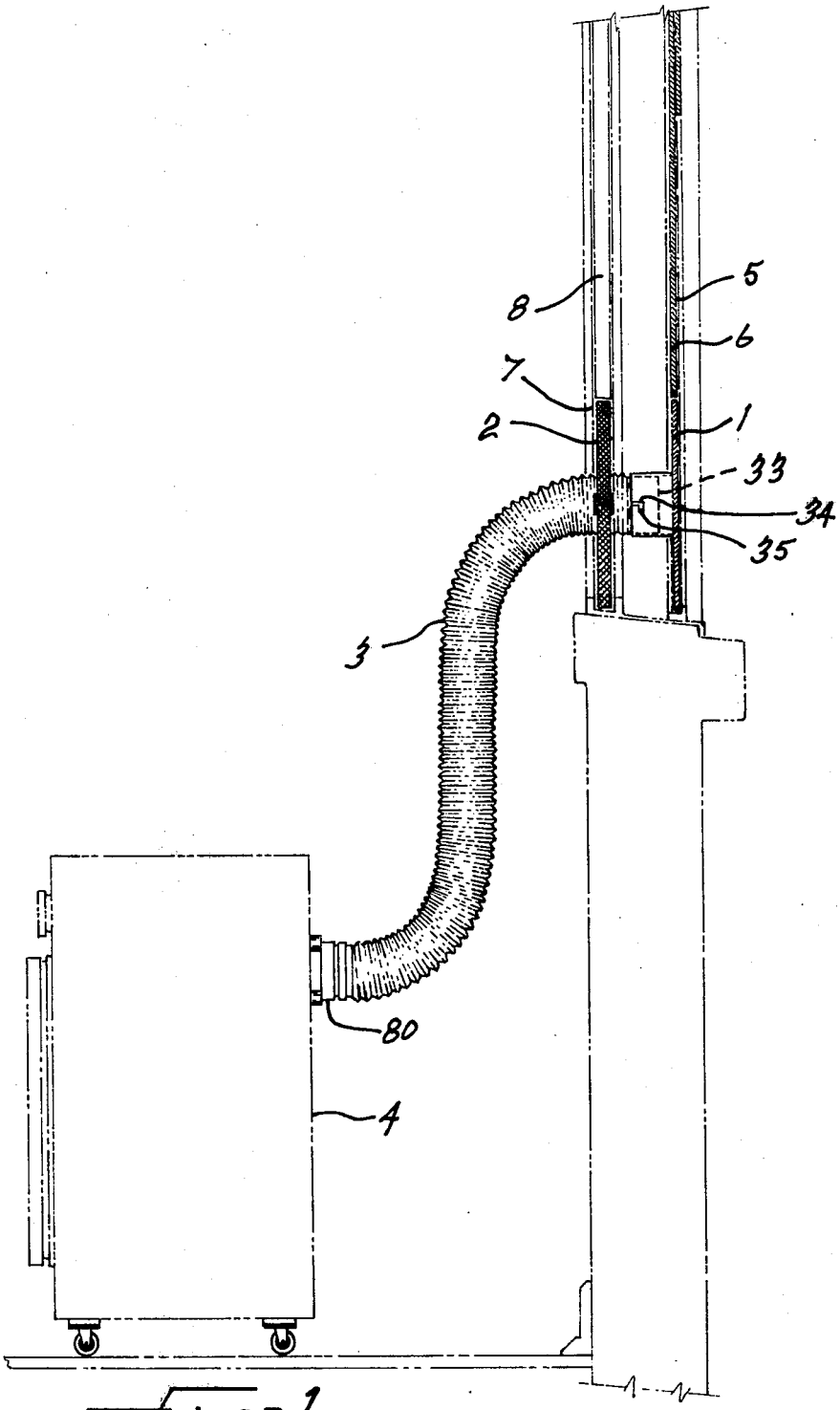
FIG. 1 is a vertical section of a double window unit showing the window insert plate assemblies in accordance with the invention inserted therein and showing in elevation a flexible hose connected to a laundry dryer, shown in dot-and-dash lines.

FIG. 1 shows the general assembly of the invention wherein a laundry dryer 4 has its hot and humid air exhaust connected by means of a removable coupling assembly 80 to a flexible hose 3, the other end of which, indicated at 33, is removably connected to an opening made in an outer window insert plate assembly 1 for the exhaust to the exterior of the building of the hot and humid air from the laundry dryer 4.

Exterior window plate assembly 1 is fitted within the side channels of a standard aluminum window frame 5 with the guillotine type lower window sash 6 in sealing contact with the top edge of plate assembly 1, so as to prevent entrance of outside air into the room where the laundry dryer is located.

In the case of a double window construction as shown, an inner window plate assembly 2 is fitted within the inner window opening in the side channels 7 thereof with the guillotine type lower window sash 8 in sealing contact with the top edge of assembly 2. This plate assembly 2 defines an opening for the passage of flexible hose 3.

FIG. 1 also shows how the outer nipple 33 defining the outer end of hose 3 is provided with an outwardly protruding pin 35 removably engageable with an L-shaped slot 34 of the sleeve of the exhaust opening of plate assembly 1. The construction of the latter is shown in FIGS. 2 to 5. It consists of two telescopically-engaged sections 9 and 10 to fit window openings of different widths. The two sections each consist of a rectangular flat plate, preferably made of transparent material, such as clear synthetic resin. Section 9 has inturned L-shaped guide rails 12 at the top and bottom longitudinal edges adapted to fit over the outturned longitudinally extending L-shaped guide rails 13, provided at the top and bottom longitudinal edges of section 10. Thus, the two sections 9 and 10 can slide relative to each other along their guide rails 12 and 13. The top outer corners of sections 9 and 10 are provided with an outwardly protruding metal pin 11, adapted to fit within the side channels of the aluminum window frame 5 to prevent removal of the plate assembly 1. Also, the two sections 9 and 10 can be locked in position within the window opening by means of a latch system, shown in FIG. 3, and comprising a latch lever 18 pivoted to ears 15 secured to section 10 and having a pawl 16 engageable with any of the teeth of rack 17 formed at the bottom of the guide rail 12 of section 10. A handle 14 protruding from the inside face of section 10 facilitates the extension movement of the plate assembly 1. Section 9 has a circular opening 29 serving as the exhaust outlet.

FIGS. 6 to 8 show a first embodiment of the inner window plate assembly, which is also extendable to fit inner window openings of different widths. It has a generally rectangular shape and is composed of two rigid plate sections, namely: a lower plate section 19 and a top plate section 20 sealed together at their longitudinal junction by means of a sealing strip 21, of H-shaped cross-section, so as to provide flanges overlying the surfaces of the two sections 19 and 20 with an intervening web contacting the longitudinal edges of said sections.

Sections 19 and 20 are provided with registering semi-circular notches at their contacting edges to form the circular opening 22 for the passage of flexible hose 3 when the two sections 19 and 20 are assembled. The top edge of the upper section 20 and the lower edge of the lower section 19 are lined with sealing strips 26 to make sealing contact with the bottom edge of the window sash and the sill of the inner window opening, respectively.

The plate assembly 2 is extensible to fit inner window opening of different widths. For this purpose, telescopic top and bottom sections 24 and 25, respectively, have each a tongue 23 telescopically engaged in a groove at the corresponding end of upper and lower sections 20 and 19, respectively.

The inner window plate assembly 2 of FIGS. 6 to 8 can be replaced, if desired, by the telescopic inner window plate assembly (shown in FIGS. 15 to 19) and preferably made of clear plastic material. This assembly is similar to the outer window plate assembly 1, illustrated in FIGS. 2 to 5 inclusive. It comprises telescopically-engaged rectangular plate sections 102 and 103 to fit window openings of different widths. Section 102 has inturned guide rails 109 at its top and bottom longitudinal edges slidably engaging outwardly directed guide rails 108 at the top and bottom longitudinal edges of section 103. The latter has a handle 105 to facilitate extension and retraction of the plate assembly.

Section 102 has a notch 106 through which extends the flexible hose 3. This notch 106 has a rounded bottom end and opens in full diameter at the top edge of section 102, and once the hose has been inserted in notch 106, a plate 104 is slidably inserted within vertical guide grooves 107 of section 102. Plate 104 has a semi-circular inner edge completing the circular opening in notch 106 through which the hose 3 extends.

All the window insert plate assemblies and window opening closure means in accordance with the invention are preferably of clear plastic material, so as not to diminish the light entering the room in which the dryer is located and also for esthetic reasons not to disfigure the window as seen from the outside.

The window insert plate assemblies of the invention can also fit windows in which the window sashes are horizontally slidable.

The outlet opening 29 of the outer window plate assembly 1, illustrated in FIGS. 2 and 3, is fitted with a closure means to close the outlet of the flexible hose 3, or the interior of the room when the laundry dryer is not used.

This means is illustrated in FIGS. 9 to 14. It comprises a circular sleeve 27 having an annular flange 30 at one end, adapted to be secured around opening 29 of the plate section 9 of the assembly of FIGS. 2 to 5 on the inside face of said section.

A tube 28, of a length equal to about twice the length of sleeve 27, is slidably fitted within sleeve 27. Tube 28 has an outwardly extending flange 41 at its inner and abutting against the inner end of sleeve 27 in the outwardly projecting position of the tube 28 to prevent further outward movement of the tube, as shown in FIG. 12. The outer end of tube 28 is closed by an end disc 32 having a marginal portion radially outwardly protruding from the tube 28. In the retracted closed position of the tube 28, the peripheral portion of disc 32 abuts against the flange 30 of sleeve 27 fitting within the annular space defined around the tube 28 by the opening 29 of plate section 9.

The lower half-portion of the outer section of tube 28 is provided with a series of parallel longitudinally extending exhaust slots 36 which are closed to the outside air in the retracted position of tube 28 and which establish an outlet between the flexible hose 3 and the outside air in the protruding position of the tube 28.

Tube 28 can be locked either in retracted or in protruding position by means of a latch lever 31 pivoted at 43 intermediate its ends to a pair of ears upstanding from the top of sleeve 27. Latch lever 31 extends longutidinally of the sleeve and its outer end is urged upwardly by a coil spring 40 inserted between the top of the sleeve 27 and the underside of lever 31. The inner end of lever 31 carries a downwardly extending locking pin 37 adapted to engage anyone of two holes 39 made in tube 28 to lock the latter either in protruding position, as shown, or in retracted position with end disc 32 flat against flange 30 and flush with the window plate section 9. To prevent rotation of tube 28 within sleeve 27, the top of tube 28 is provided with a longitudinally extending groove 38 ending at each stop hole 39 and in which pin 37 lies during slidable movement of tube 28. Cap 42 (see FIG. 14) is adapted to fit within the inner end of tube 28 to form an additional closure against outside cold air when the flexible hose 3 is not connected to tube 28. For coupling of the hose 3 to tube 28, the latter is provided with an L-shaped slot 34, at its inner end (see FIG. 11), adapted to receive an external locking pin 35 secured to nipple 33 (see FIG. 1). This nipple 33 fits within tube 28 at one end, while its other end fits within the outer end of hose 3 and is firmly connected thereto by means of a strap.

As shown in FIG. 1, the inner or dryer end of flexible hose 3 is inserted over a nipple 80 and secured thereto by a surrounding band 81. Nipple 80 is formed at its inner end with a collar having a plurality, for instance four, radially outwardly protruding equally angularly spaced ears 84, each carrying a permanent magnet 82 flush with the outside face of ear 84, so as to magnetically adhere to the steel wall portion surrounding the dryer exhaust outlet for the humid and hot air to make a communication with the hose 3.

The window insert plate assemblies and window opening closure means in accordance with the invention are preferably of clear plastic material, so as not to diminish the light entering the room in which the dryer is located and also for esthetic reasons not to disfigure the window as seen from the outside.

The window insert plate assemblies of the invention can also fit windows in which the window sashes are horizontally slidable.

The window opening closure means of FIGS. 9 to 14 can be directly installed in an opening cut directly in the glass pane of a window sash of the pivotable type.

The exhaust system can be used in association with other appliances requiring outside venting, such as a kitchen hood.

What we claim is:

1. An air exhaust system for a laundry dryer and the like located in a room having a window including a window frame and a window sash slidable therein, and having an air exhaust outlet, comprising a window insert plate assembly removably inserted within said window frame and with said window sash contacting an edge of said window insert plate assembly, said window insert assembly including telescopically engaged rectangular plate sections to fit window frames of different widths, one of said plate sections having an aperture, a sleeve secured to said window insert plate assembly co-axial with said aperture and extending inwardly of said window insert plate assembly, a tube slidably inserted within said sleeve, a closure disc secured to the outer end of said tube, said tube having a length about twice the length of the sleeve and capable of taking a retracted position with said outer closure disc substantially flush with said window insert plate assembly and a protruding position wherein said tube has an outer portion protruding from said window insert plate assembly, said outer portion having a plurality of openings made in the lower half-portion thereof, means to prevent rotation of said tube with respect to said sleeve but allowing longitudinal movement of said tube within said sleeve, and further including a flexible venting hose having detachable connecting means at both ends for detachably connecting one end of said hose to the inner end of said tube and the other end of said hose to the exhaust outlet of a laundry dryer, said sleeve and tube assembly preventing air circulation between said room and the outside in both positions of said tube when said hose is connected to said tube and to said laundry dryer exhaust outlet.

2. An air exhaust system as claimed in claim 1, further including means to removably lock said tube in projecting or retracted position, and means including a lever pivoted intermediate its ends on said sleeve, a pin carried by the outer end of said lever, the other end of said lever being spring-urged to force said pin through registering holes made in said sleeve and said tube, said tube having two such holes longitudinally spaced along said tube for selectively receiving said pin in the projecting and retracted position of said tube, respectively, said means to prevent rotation of said tube including a longitudinally extending groove terminating at said two holes at the outside of said tube and in which said pin slides during retracting and projecting movement of said tube, respectively.

3. An exhaust system as claimed in claim 1, wherein the means for detachably connecting one end of said flexible venting hose to the exhaust outlet of a laundry dryer, includes a collar fixed to the inlet end of the hose and carrying a plurality of permanent magnets spaced around said inlet and adapted to contact the steel wall of a laundry dryer around the exhaust outlet thereof and retain the hose in position.

4. An exhaust system as claimed in claim 1, wherein said sleeve has a slightly smaller diameter than the diameter of the opening in said window insert plate, and is provided with a radially projecting flange at one end, said flange secured to the inside face of said window insert plate around said opening, whereby an annular recess is defined by said opening around said tube and wherein said disc protrudes radially outwardly from said tube and fits within said annular recess in the closed retracted position of said tube, whereby said disc is flush with said plate.

5. An exhaust system as claimed in claim 1, further including latch means to removably secure the rectangular plate sections in adjusted extended position.

6. An exhaust system as claimed in claim 5, wherein said latch means include a pivotally mounted latch lever carried by one of said plate sections and engageable with rack teeth formed longitudinally of the other plate section.

7. An exhaust system as claimed in claim 1, further including an interior window insert plate assembly including telescopically-engageable plate sections, one section having a notch opening at one longutudinal edge of said section and having a curved inner edge of a diameter of fit around a flexible hose, said notch having straight edges merging with said curved inner edge, guide rails secured along said straight edges, and a closure plate slidably engageable with said guide rails and having an inner curved end conforming to the hose outside diameter.

8. An exhaust system as claimed in claim 1, further including an inner window plate assembly including top and bottom rectangular plates contacting along a longitudinal horizontal edge, each edge of the two top and bottom plates having a semi-circular notch registering for surrounding the flexible hose, one end of each of said two plates having a slot and an extendable portion for each top and bottom section having a tongue telescopically engageable in said slot to adjust the length of said inner window plate assembly to fit window openings of various widths.

* * * * *